United States Patent [19]

Nakamura

[11] Patent Number: 4,790,436

[45] Date of Patent: Dec. 13, 1988

[54] RESEALABLE DISPENSER-CONTAINER

[76] Inventor: Kenji Nakamura, 3-7, Nishiawaji 6-chome, Higashiyodogawa-ku, Osaka, Japan

[21] Appl. No.: 64,888

[22] Filed: Jun. 22, 1987

[30] Foreign Application Priority Data

Jun. 23, 1986 [JP] Japan ..... 61-095832[U]
Aug. 22, 1986 [JP] Japan ..... 61-128777[U]

[51] Int. Cl.[4] ..... B65D 61/18

[52] U.S. Cl. ..... 206/449; 206/607; 206/613; 206/621; 206/629; 206/813; 206/494; 220/258

[58] Field of Search ..... 220/255, 253, 256, 258, 220/257; 206/205, 613, 607, 629, 621, 631, 632, 633, 812, 813, 494

[56] References Cited

U.S. PATENT DOCUMENTS 4,059,201 11/1977 Foster ..... 220/258
4,156,493 5/1979 Julius .
4,185,754 1/1980 Julius .
4,420,080 12/1983 Nakamura .
4,538,396 9/1985 Nakamura .
4,552,269 11/1985 Chang .
4,562,936 1/1986 Deflander ..... 220/258
4,610,357 9/1986 Nakamura .
4,616,470 10/1986 Nakamura .
4,651,874 3/1987 Nakamura .
4,653,250 3/1987 Nakamura .

FOREIGN PATENT DOCUMENTS 6037329 11/1985 Japan .
458541 12/1936 United Kingdom ..... 220/258
1149296 4/1969 United Kingdom ..... 220/258

*Primary Examiner*—Joseph Man-Fu Moy
*Attorney, Agent, or Firm*—Burgess Ryan & Wayne

[57] ABSTRACT

A resealable dispenser-container comprising: one or more containers, made of a flexible sheet; and a shape maintaining member, made of a material harder than the container.

The container contains contents, such as wet tissues, cookies, biscuits, nails, and has an opening for dispensing the contents therethrough or a weakened line for forming the opening.

A flap made of a flexible sheet material covers the opening or weakened line and is repeatedly attached to or removed from the container by means of a pressure sensitive adhesive.

The shape maintaining member is formed in a box, a plate or a frame and has an opening or a weakened line for forming the opening which opening or weakened line is larger than the opening or weakened line formed in the container.

The opening or weakened line formed on the container being located within the opening or a region surrounded by the weakened line formed in the shape maintaining member.

The sheet of the container being fixed to the shape maintaining member at a position near the opening or weakened line formed in the container.

32 Claims, 5 Drawing Sheets

RESEALABLE DISPENSER-CONTAINER

BRIEF DESCRIPTION OF THE INVENTION

Background of the Invention

The present invention relates to a resealable dispenser-container for containing home use goods which are repeatedly consumed, particularly a dispenser-container suitable for containing wet tissues, which are fibrous materials, such as non-woven fabrics, gauze, or cotton, having a cleaning solution such as alcohol, or liquid cosmetic, impregnated therein.

PRIOR ART

As a typical example of home use goods, which are repeatedly consumed, recently, wet tissues, i.e., fibrous materials, impregnated with a cleaning solution including alcohol, moisturing agent or surfactant and so on, have been utilized widely for cleaning skin.

In conventionally known dispenser-containers for wet tissues, the wet tissues packed in a blow molded or vacuum formed container are usually for home use, and the wet tissues packed in a small bag made of liquid impervious sheet or in a small plastic container are for portable use.

The conventionally known bag type dispenser-container of wet tissues for portable use usually contains about 10 tissues and is a flat bag. The dispenser-container has an opening and a resealable flap for covering the opening. For example, the resealable flap may be made of a sheet having pressure sensitive adhesive coated on one side thereof, and the sheet is attached to the dispenser-container so that it covers the opening formed on the dispenser-container.

Another dispenser-container of the bag type has a U-shaped slit formed thereon, and the region surrounded by the slit is used as a flap while a small piece of sheet, which is larger than the flap, which has pressure sensitive adhesive coated thereon and which has an opening for dispensing the wet tissues therethrough, is attached to the portion corresponding to the above-described slit from the inside of the dispenser-container.

Examples of other home use goods, which are repeatedly consumed, are: foods, such as cookies, biscuits, chocolates or soup squares: stationery, such as clips; fastening articles, such as nails, nuts, or machine screws. In general, these goods are directly contained in a box or in a bag having no dispensing opening.

Manufacturing cost of the conventionally known containers for home use wet tissues are expensive, since blow molded containers or vacuum formed containers are used.

Contrary to this, the above-described dispenser-containers of the bag type for wet tissues can be manufactured at a cost lower than that required for the molded containers, because the dispenser-containers can be easily made of a flexible sheet material at a high manufacturing efficiency. The dispenser-container can be easily handled when it contains a small number of wet tissues as for portable use. However, the bag type dispenser-container is not suitable as a container for home use wet tissues, which usually contains 50 to 70 tissues, because it is not easy to handle.

More specifically, the following problems are inherent in the bag type dispenser-container made of a flexible sheet, the size of which is large, or the depth of which is large, and which has a large amount of tissues contained therein, in other words, the dispenser-container has a large distance between the surface, i.e., the upper surface, having an opening, and the opposite surface, i.e., the bottom surface. Wet tissues can be smoothly dispensed, and the flap can be smoothly resealed at the beginning of use of the dispenser-container, since the shape of the dispenser-container is firmly maintained by the wet tissues filled within the dispenser-container up to the opening. However, as the wet tissues are dispensed, the original shape of the dispenser-container cannot be kept since the number of the wet tissues remaining in the dispenser-container becomes small. As a result, the wet tissues cannot be smoothly dispensed from the dispenser-container due to the deformation of the dispenser-container, or the flap cannot be smoothly removed from or attached to the dispenser-container due to the waving of the sheet of the dispenser-container at the time of opening and closing the opening. Especially, if the dispenser-container is distorted or the surface where the flap is attached is waved when the flap is resealed on the dispenser-container after the flap has been opened to dispense the wet tissues, the flap cannot be firmly attached to the dispenser-container, and a small clearance may be formed between the surface of the dispenser-container and the flap. The liquid contained in the wet tissues may be evaporated through the small clearance, and accordingly, there is a problem that the wet tissues are dried.

Further, conventional cookies or biscuits packaged in a box or bag can not be sealed again once the box or bag is unpacked. Accordingly, dry cookies or biscuits may become damp, or wet cakes may become dry. In addition, dust may enter into the box or bag through clearances, and there is an unsanitary problem.

OBJECTS OF THE INVENTION

It is an object of the present invention to provide a dispenser-container for wet tissues, which can obviate the above-described problems inherent in the conventional dispenser-container for wet tissues, and wherein wet tissues can be always smoothly dispensed and flap can be securely opened and resealed, even if the size of the wet tissues to be contained is large or the number of the wet tissues becomes large.

It is another object of the present invention to provide a dispenser-container, which is not limited to use for wet tissues but is also suitable for containing goods which will be consumed repeatedly.

SUMMARY OF THE INVENTION

According to the present invention, the above-described problems are obviated by a resealable dispenser-container comprising:

a container, which is made of a flexible sheet; and a shape maintaining member, which is made of a material harder than the container:

the container containing contents:

the container having an opening for dispensing the contents therethrough or a weakened line for forming the opening and a flexible flap which covers the opening or weakened line and which is repeatedly opened and closed;

the shape maintaining member having an opening or a weakened line for forming the opening which opening or weakened line is larger than the opening or weakened line formed in the container;

the opening or weakened line formed on the container being located within the opening or a region surrounded by the weakened line formed in the shape maintaining member: and the sheet of the container being fixed to the shape maintaining member at a position near the opening or weakened line formed in the container.

According to the present invention, since the sheet of the container having an opening formed therein is fixed to the shape maintaining member, the condition of the container is always kept at that of the beginning of its use wherein contents are filled therein, regardless of the amount of the contents remaining in the container.

Accordingly, a flap can always be surely opened and closed from the beginning of its use to the end of its use, even when the container contains a large amount of contents and has a large thickness.

Further, the dispenser-container of the present invention can be manufactured by fixing the surface of the container having an opening to the shape maintaining member, and the dispenser-container can be readily and effectively manufactured in a conventional bag making process or a conventional carton forming process without performing the blow molding or the vacuum forming. In addition, the price of material of the dispenser-container of the present invention is low, and therefore, the dispenser-container can be economically manufactured.

BRIEF DESCRIPTION OF THE INVENTION

The present invention will now be explained in detail with reference to the illustrated embodiments, wherein.

Figure 8:
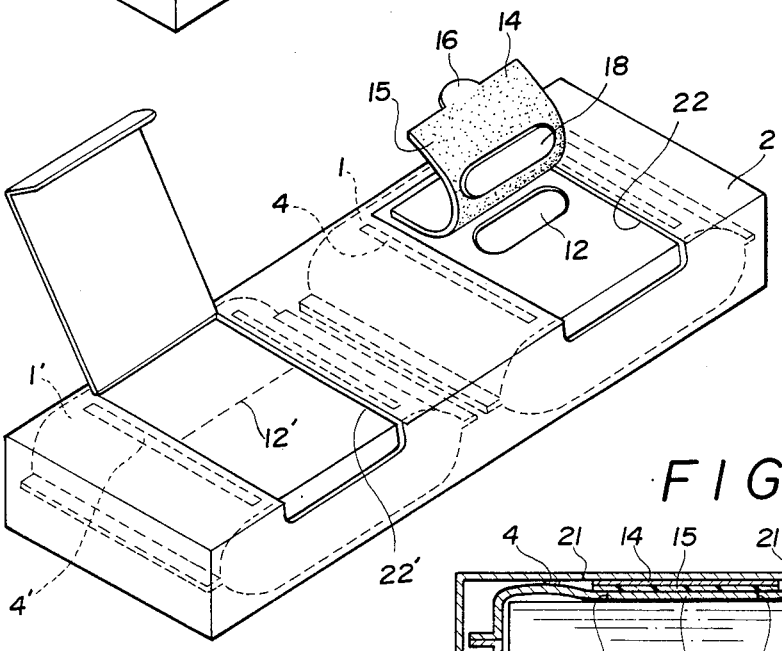
Figure 9:
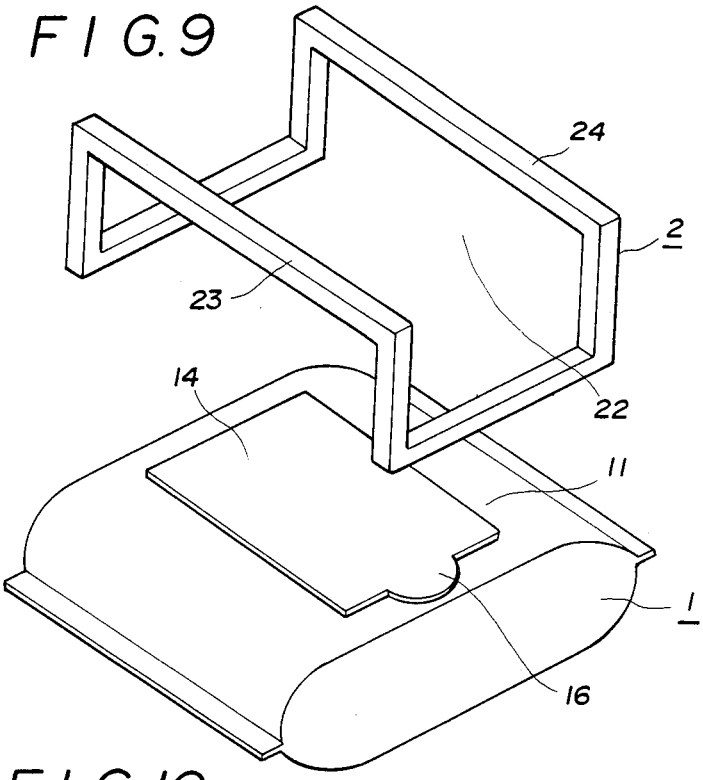
Figure 10:
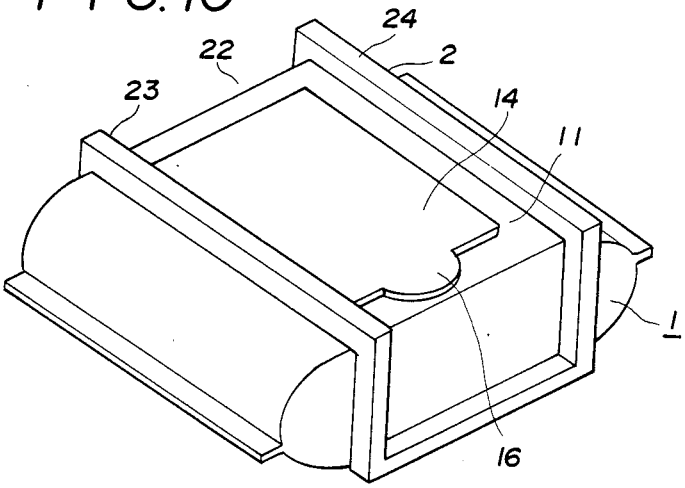
Figure 11:
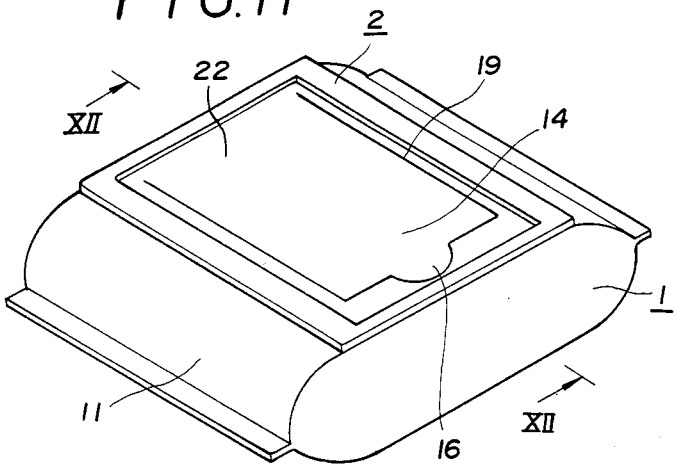
Figure 12:
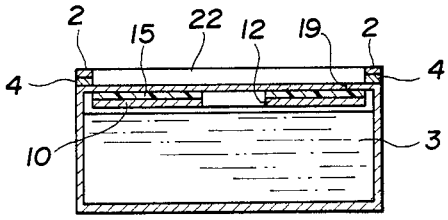
Figure 13:
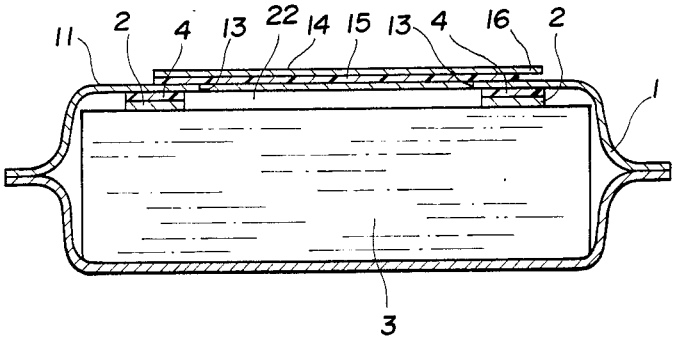

FIG. 8. is a perspective view showing the fourth embodiment of the dispenser-container of the present invention:

FIG. 9 is an exploded perspective view of the fifth embodiment of the dispenser-container of the present invention;

FIG. 10 is a perspective view wherein the dispenser-container illustrated in FIG. 9 is assembled:

FIG. 11 is a perspective view showing the sixth embodiment of the dispenser-container of the present invention:

FIG. 12 is a cross sectional view taken along the line XII—XII in FIG. 11: and FIG. 13 is a cross sectional view of the seventh embodiment of the dispenser-container of the present invention.

PREFERRED EMBODIMENTS

The first embodiment of the present invention will now be explained with reference to FIG. 1, which is a perspective view of the embodiment, FIG. 2, which is a cross sectional view taken along the line II—II in FIG. 1, and FIG. 3, which is a perspective view showing the using condition of the embodiment.

Figure 1:
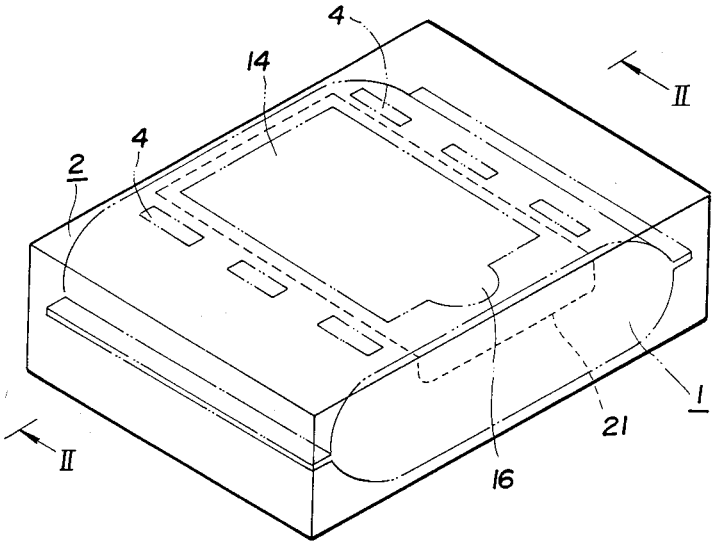
FIG. 1 is a perspective view of an embodiment of a dispenser-container of the present invention.

The dispenser-container of the present invention comprises a container 1, made of flexible sheet and illustrated by an imaginary line, i.e., two dot and a dash line, in FIG. 1, and a shape maintaining member 2 made of a material harder than that of the container 1.

Figure 2:
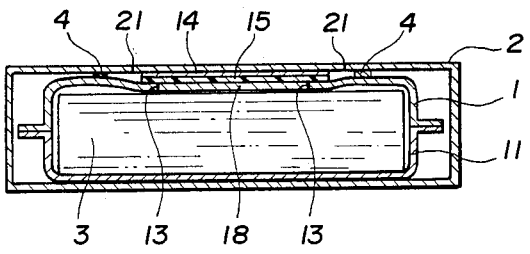
FIG. 2 is a cross sectional view taken along the line II—II in FIG. 1.

In the illustrated embodiment, container 1 contains wet tissues 3 (see FIG. 2). The container 1 has an opening 12 for dispensing the wet tissues 3 therethrough and a flap 14 for covering the opening 12, and the construction of the container may be similar to that of the conventionally known portable dispenser-container of the bag type for wet tissues.

Although the wet tissues are exemplified as the contents 3 contained in the container 1 in the following explanation, the contents of the present invention are not limited to wet tissues. Goods, which are not simultaneously consumed but are consumed repeatedly and which require shelf stability, dust proof ability, fungus proof ability, gas tightness or liquid tightness, are suitable for the contents 3 of the present invention.

Examples of contents are: cosmetic articles, wherein liquid cosmetic or milky lotion is impregnated in fibrous materials such as non-woven fabrics or cotton: medical supplies such as gauze, applicators, absorbent cotton, or gauze impregnated with an antiseptic or a medicine; fastening articles, such as nails, nuts, machine screws: stationery, such as clips and foods, such as cookies, biscuits, chocolates, wet cakes or soup squares.

The flexible sheet constituting a container body 11 may be a film made of synthetic resins such as polyethylene, polypropylene, polyamide, polyester, and polyvinyl chloride, and the film may be a single layer or a larinated layer. The film may be a laminated layer of the above-mentioned film and an aluminum foil or paper.

The sheet constituting container body 11 may be gas impervious or liquid impervious depending on the contents 3 contained in the container body 11. For example, it is preferred to use a gas impervious sheet or a liquid impervious sheet for the containers for containing wet tissues, fibrous materials impregnated with liquid cosmetics or a medicine, or wet cakes (e.g. fruit cakes). It is preferred to use a gas impervious sheet so as to prolong the effects of the enclosed agents when dry cookies are packaged with a drying agent or when nails are packaged with rust preventatives.

Figure 3:
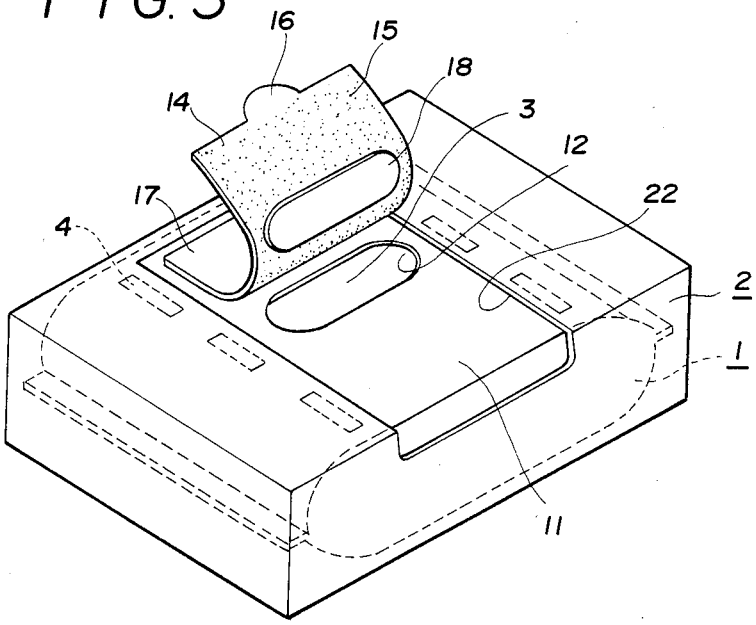
FIG. 3 is a perspective view showing the using condition of the embodiment illustrated in FIG. 1.

In the first embodiment illustrated in FIGS. 1 to 3, the flap 14 of the container 1 is a piece of a sheet which is independent from the container body 11. The material of the flap 14 may be a liquid impervious sheet which is similar to that of the container body 11. In this embodiment, both the sheet of the container body 11 and the flap 14 are liquid impervious.

The flap 14 has a pressure sensitive adhesive 15, such as polyester, acrylic or rubber adhesive, applied to one side thereof, i.e., the side contacting with container body 11, except for a grip portion 16. The flap 14 can be repeatedly adhered to and removed from the container body 11 while it covers the dispensing opening 12 formed in the container body 11 or the weakened line 13 for forming the dispensing opening 12.

It is preferred that an end 17 of the flap opposite to the grip 16 is fixed to the container body 11 by heat sealing or adhesive or that the flap 14 has slits extending from its sides so that the portion located ahead of the slits is prevented from being removed.

The dispensing opening 12 formed in the container body 11 may be formed in any suitable shape, such as an ellipse, a circle, a rectangle or a rhombus. When the dispensing opening 12 is formed by a weakened line 13 (see FIG. 2), the weakened line 13 may be a perforated line when it is seen in the plan view of the container body 11 or a V-shaped slit when it is seen in a cross sectional view taken along the thickness direction of the sheet forming the container body 11. The weakened line is formed on the container body 11 to form a closed loop or an open loop such as a U-shape when it is seen in the plan view of the container body 11.

When the flap 14 is opened first to use the wet tissues 3, the portion 18 surrounded by the closed loop or the open loop is removed from the container body 11 and is kept to be attached to the flap 14, and the area, from which the portion 18 is removed, becomes the dispensing opening 12.

In the embodiment illustrated in FIG. 3, the weakened line 13 is formed on the container body 11 by a perforated line forming a closed looped ellipse. When the flap 14 is opened, the portion 18 surrounded by the closed loop is removed from the container body 11 and is kept attached to the pressure sensitive adhesive 15 on the flap 14, and the trace of the removed portion 18 becomes the dispensing opening 12.

In the embodiment illustrated in FIG. 1, the shape maintaining member 2 is formed by a box which is formed in a rectangular parallelepiped and which surrounds the container 1. The box 2 is made of a material which is somewhat harder than that of the container 1. The material of the box 2 may be a sheet material, such as a paper, a laminated layer of paper and an aluminum foil, or a synthetic resin sheet, which sheet material is suitable for bending or punching.

The shape of the box 2 is not limited to the rectangular parallelepiped, and the surface may be curved or bent, for example, formed in a barrel shape or in an elliptical or circular cross section.

In the embodiment illustrated in FIG. 1, the box 2 is provided with a weakened line 21 illustrated by a broken line which surrounds a region larger than the flap 14 and which may be formed by a perforated line. When the weakened line 21 is removed, an opening 22 is formed as shown in FIG. 3.

As it is apparent from FIGS. 1 and 3, the flap 14 is located within the region in the box 2 surrounded by the weakened line 21, i.e., within the portion wbich will form the opening 22. Accordingly, when the portion in the box 2 surrounded by the weakened line 21 is removed to form the opening 22 as illustrated in FIG. 3, the flap 14 of the container 1 is exposed, and the flap 14 can be freely opened and sealed again through the opening 22.

In the embodiment illustrated in FIG. 1, the weakened line 21 is formed in a closed loop and can be completely removed. In an alternative embodiment, the weakened line 21 may be formed in an open loop, for example, in a U-shape, so that a part of the cut portion is kept to be connected to the body of the box 2. When the latter construction is applied, the cut portion surrounded by the open loop can be used as a flap of the box 2 if the connecting portion can be bent.

In the first embodiment, the box 2 and the container 1 are fixed to each other by an adhesive 4 by attaching the portion of the container 1 located near the dispensing opening 12 or the weakened line 13 for forming the dispensing opening 12 to the portion on the box 2 located outside the portion surrounded by the weakened line 21.

The adhesive 4 is adequately selected taking the materials of the box 2 and the container 1 into consideration. For example, emulsion adhesive, solvent type adhesive, hot-melt adhesive, or pressure sensitive adhesive is suitable, which may be made of acrylic ester adhesive, polyvinyl acetate resin adhesive, polyurethane resin adhesive, silicone adhesive, epoxy polyester resin adhesive, polyamide adhesive, or polyolefin. The amount of the adhesive 4 is so selected taking the size of the container 1 into consideration that the box 2 and the container 1 are surely fixed to each other.

When the dispenser-container for wet tissues of the first embodiment is manufactured, container 1 and a sheet material punched in a shape which corresponds to the box 2 and provided with a weakened line 21 are prepared first. Then the adhesive 4 is applied to the sheet material for the box or to the surface of the container 1, and the container 1 is placed on the sheet material for the box in such a manner that the flap 14 is located within a region surrounded by the weakened line 21. Thereafter, the sheet material for the box is bent by a usual carton former or cartoning machine to form the box 2. It is recommended to add such a device that can apply adhesive to a portion on the box 2 near the weakened line 21 or the opening 22 or to the surface of the container 1, which device is not disposed on a conventional carton former or cartoning machine, though the conventional machine is provided with a device for applying adhesive to form the box. Further, it is preferred that the flaps formed at the sides of the box 2 are fixed to the main body of the box by adhesive in order to enhance the strength of the box 2.

In place of the above-described application of adhesive, a small piece of aluminum foil provided with hot-melt adhesive on both the sides may be placed between the box 2 and the container 1, and the box 2 and the container 1 are pressed to each other after the foil is heated by means of high frequency dielectric sealing.

When the dispenser-container of the present invention which has been manufactured in the process described above is used, the opening 22 is formed first by removing the weakened line 21 from the box 2. The grip 16 of the flap 14 exposed outside from the opening 22 is picked up to open the flap 14. Thus, the weakened line 13 formed on the container body 11 for forming the dispensing opening 12 is removed, and the removed portion 18 is attached to the flap 14 while the portion from where the portion 18 is removed forms a dispensing opening 12, through which the wet tissues 3 can be dispensed.

After the desired number of the wet tissues 3 are taken out, the flap 14 is closed again and is adhered to the container body 11.

Since the surface of the container body 11 near the flap 14 is fixed to the box 2, the surface of the container body 11 near the flap 14 is kept in a tight condition even when the amount of the wet tissues remaining in the container body 11 becomes small as the wet tissues are dispensed. Accordingly, the removal and attachment of the flap 14 can be surely performed.

Further, since the container 1 is contained in the box 2 and the upper surface having the flap 14 is fixed to the box 2, the shape of the container 1 is not deformed nor distorted even when the amount of the wet tissues 3 remaining in the container body becomes small. Accordingly, the wet tissues 3 contained in the container 1 remain flat as they were flat upon beginning of use, and they can be smoothly dispensed.

Figure 4:
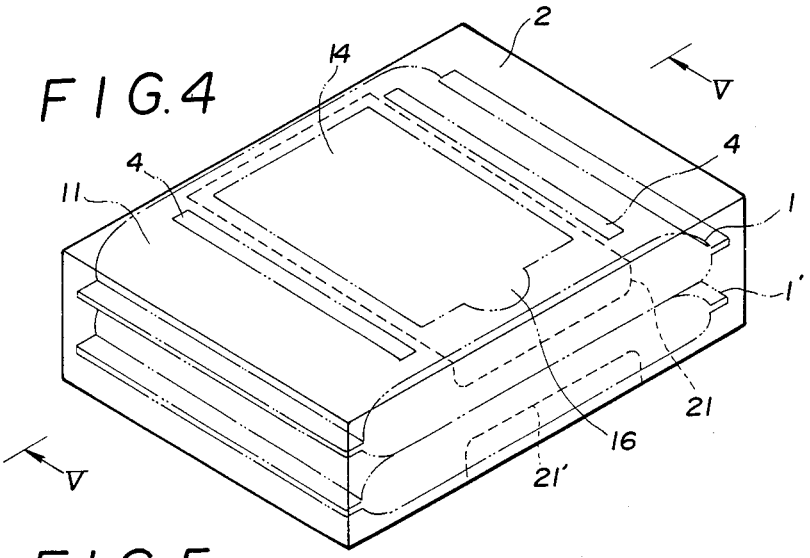
FIG. 4 is a perspective view showing the second embodiment of the dispenser-container of the present invention.
Figure 5:
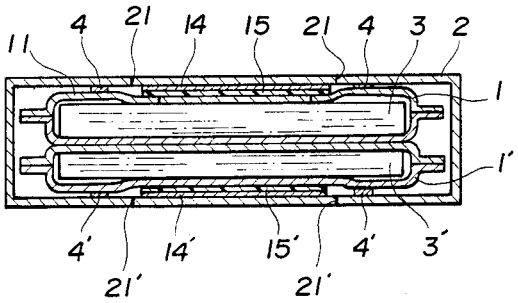
FIG. 5 is a cross sectional view taken along the line V—V in FIG. 4.

The second embodiment of the present invention will now be explained referring to FIGS. 4 and 5. FIG. 4 is a perspective view showing the second embodiment, wherein the containers 1 and 1' are illustrated by imaginary lines, i.e., two dot and a dash lines similarly to FIG. 1. FIG. 5 is a cross sectional view taken along the line V—V in FIG. 4.

In the second embodiment, two containers 1 and 1' overlap each other and are contained within a box 2. The box 2 has weakened lines 21 and 21' on the upper and lower surfaces thereof, and the containers 1 and 1' are fixed to the box 2 by adhesive 4 and 4'. The first container 1 and the second container 1' may be of a similar type or of different types.

The containers 1 and 1' may contain different contents, for example, wet tissues 3 having different cleaning solutions impregnated therein which are different from each other in their properties, such as colors, or fragrance, or usage.

Alternatively, the second container 1' may contain dry tissue papers and may not be provided with any flap.

The other constructions are similar to those in the above-explained first embodiment.

Figure 6:
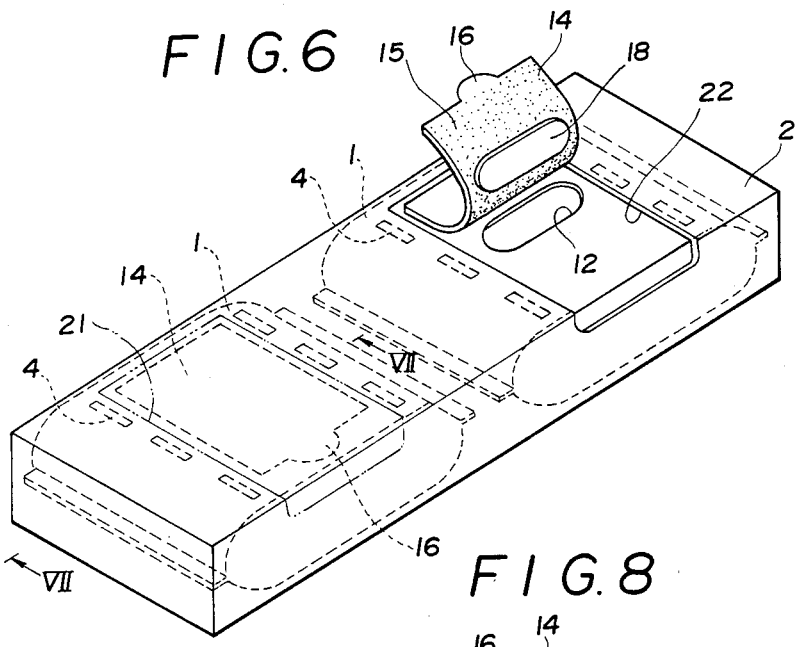
FIG. 6 is a perspective view of the third embodiment of the dispenser-container of the present invention.
Figure 7:
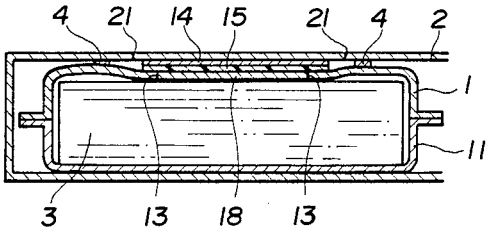
FIG. 7 is a cross sectional view taken along the line VII—VII in FIG. 6.

The third embodiment of the present invention will now be explained referring to FIGS. 6 and 7. FIG. 6 is a perspective view of the third embodiment, and in FIG. 6, containers 1 and 1 are illustrated by a broken line and weakened line 21 for forming opening are illustrated by a two dot and a dash line. FIG. 7 is a cross sectional view taken along the line VII—VII in FIG. 5.

In this embodiment, the two containers 1, made of flexible and liquid impervious sheet, are parallelly disposed side by side in a box type shape maintaining member 2 made of a material harder than that of the containers 1.

In this embodiment, differing from the embodiment illustrated in FIG. 5, the flaps 14 and 14 of the containers 1 and 1, and accordingly, the openings 12 and 12, are located at the same side of the box 2. Therefore, the contents contained in the two containers 1 and 1 can be simultaneously dispensed while the box 2 is kept as it is without turning the box 2.

For example, the containers contain wet tissues 3 contained in both the containers have liquid cosmetic and milky lotion impregnated therein, respectively. The wet tissues impregnated with liquid cosmetic are taken up first from one container 1 and used. Then, the wet tissues impregnated with milky lotion are taken up from the other container 1 and used.

The remaining construction of the containers may be similar to that in the above-explained second embodiment.

Although the flaps 14 are opened and sealed in a direction transverse to the containers 1 in the embodiment illustrated in FIG. 6, the flaps may be opened and sealed in a longitudinal direction of the containers 1. Further, the longitudinal ends of the two containers 1 are located adjacently, however, the transverse ends of the containers 1 may be located adjacently. In addition, the weakened lines 21 of the box 2 may be opened in a longitudinal direction of the box 2.

FIG. 8 is a perspective view of the fourth embodiment of the dispenser-container according to the present invention.

In the fourth embodiment, a container 1 containing wet tissues and a container 1' containing dry tissue are disposed parallelly in a box 2. The box 2 has weakened lines for forming openings 22 and 22' parallelly formed at the upper surface thereof. The containers 1 and 1' are fixed to the box 2 by adhesive 4 and 4'. The second container contains dry tissues and is not provided with any flaps. An opening 12' is formed by a straight perforated line.

When the weakened line 21 is formed in an open loop, the portion surrounded by the line 21 is kept connected to the box 2 even after the weakened line 21 is cut. As a result, the portion surrounded by the line 21 can be used as a flap to cover the opening 12'. The remaining constructions are almost the same as those in the third embodiment.

According to the dispenser-container of this embodiment, the wet tissues may be taken out from the container 1 and used to remove dirt. Then, the dry tissues may be taken out from the container 1' and used to dry the portion which has been wetted by the wet tissues.

FIG. 9 is an exploded perspective view of the fifth embodiment of the dispenser-container of the present invention, and FIG. 10 is a perspective view wherein the parts illustrated in FIG. 9 are assembled.

In the fifth embodiment, the container 1 is the same as that in the first embodiment, however, the shape maintaining member 2 is formed as a frame 2. It is preferred that the frame 2 is harder and more resistant to deformation than the shape maintaining member explained in conjunction with the first embodiment. When a material similar to that used for the shape maintaining member in the first embodiment is used, it is preferred that the thickness is enhanced.

The portion between beam members 23 and 24 of the frame 2 forms the opening portion 22. As illustrated in FIG. 10, the flap 14 of the container 1 is located within the opening portion 22, and the outer surface of the container body 11 is fixed to the beam members 23 and 24 of the frame 2 by adhesive.

Since the sheet surface of the container body 11 near the flap 14 is fixed to the beam members 23 and 24 of the frame 2, the surface of the container body 11 near the flap 14 is kept in a tight condition even when the amount of the wet tissues 3 remaining in the container body 11 becomes small as the wet tissues are dispensed. Accordingly, the removal and attachment of the flap 14 can be surely performed.

Further, since the container 1 is contained in the frame 2 and the upper surface having the flap 14 is fixed to the beam members 23 and 24 of the frame 2, the shape of the container 1 is not deformed nor distorted even when the wet tissues 3 remaining in the container 1 becomes small. Accordingly, the wet tissues 3 contained in the container 1 remain flat as they were flat upon beginning of use, and they can be smoothly dispensed.

The beam members 23 and 24 of the frame 2 where the container body 11 is fixed may be curved or bent vertically or horizontally.

FIG. 11 is a perspective view showing the sixth embodiment of the dispenser-container of the present invention, and FIG. 12 is a cross sectional view taken along the line XII—XII in FIG. 11.

In this embodiment, a weakened line 19 is formed in a U-shape on a part of the container body 11 of the container 1, and the portion surrounded by the weakened line is used as a flap 14.

As illustrated in FIG. 12, a piece of sheet 10, which is larger than the flap 14, has an opening 12, which will be used as a dispensing opening, and the piece of sheet 10 is attached to a portion corresponding to the weakened line 19 from the inside of the container body 11 after pressure sensitive adhesive 15 is applied to the piece of sheet 10.

In the meantime, a shape maintaining member 2 is a flat plate 2. It is preferred that the plate 2 is relatively hard, even if it is flexible, and, for example, it may be a pasteboard, a thin plastic plate or a metal plate, such as aluminum.

The illustrated plate 2 is formed in a picture frame shape and has an opening 22 at the center thereof. The plate 2 and the container 1 are fixed to each other by adhesive in such a manner that the weakened line 19 of the container 1, i.e., the flap 14, is located within the opening 22. In this case, it is preferred that all the sides of the plate 2 are fixed to the container body 11. However, in some cases, it is possible that a part of the plate 2, for example, two parallel sides, i.e., two sides parallel to the direction in which the flap 14 is opened, or two sides perpendicular to the above-mentioned direction, are fixed to the surface of the container body 11.

The plate 2 may be curved or bent vertically in place of a flat one. Further, the shape of the illustrated plate 2 is formed in a rectangle, however, it may be formed in any suitable shape, for example, an ellipse, a rhombus, or a U-shape.

FIG. 13 is a cross sectional view showing the seventh embodiment of the dispenser-container of the present invention. In this embodiment, the construction of the container 1 per se is similar to that explained with reference to the first embodiment, however, it is different from the first embodiment in that a shape maintaining member 2 formed in a plate is inserted into the container body 11.

It is preferred that the shape maintaining member 2 of this embodiment is made of a relatively hard material like the sixth embodiment. Since the shape maintaining member 2 is contained within the container body 11, the size of the opening 22 of the shape maintaining member 2 may be smaller than the flap 14 as long as it is larger than the dispensing opening 12 or the region surrounded by the weakened line 13 for forming the opening. The shape of the shape maintaining member 2 may be altered as desired as explained in conjunction with FIGS. 11 and 12.

The shape maintaining member 2 is fixed by adhesive from the inside of the container 1 to the sheet surface near the dispensing opening 12 of the container body 11.

The dispenser-container of this embodiment is manufactured as follows. A weakened line 13 for forming dispensing opening is formed in a sheet material which will be a container body 11 upon the manufacture of the container 1, a flap 14 is attached to the sheet material, and the shape maintaining member 2 is fixed to the surface opposite to the flap 14. Thereafter, the wet tissues 3 are wrapped by the sheet material.

ADVANTAGES OF THE INVENTION

According to the present invention, since the surface of the container having an opening formed therein is fixed to the shape maintaining member, the condition of the container is always kept at that of the beginning of its use wherein contents are filled therein regardless of the amount of the contents remaining in the container.

Accordingly, a flap can always be surely opened and attached to a container from the beginning of its use to the end of its use, even when the container contains a large amount of contents and has a large thickness.

As described above, according to the dispenser-container of the present invention, contents are contained in a containers having a resealable flap, and the flap can be surely removed and attached, the dispenser-container is not limited to use for wet tissues but also suitable for containing goods which will be consumed repeatedly, and the dispenser-container has a good shelf stability, good dust proof ability, good fungus proof ability, good gas tightness or good liquid tightness.

Further, the dispenser-container of the present invention can be manufactured by fixing the surface of the container having an opening to the shape maintaining member, and the dispenser-container can be readily and effectively manufactured in a conventional bag making process or a conventional carton forming process. In addition, the price of material of the dispenser-container of the present invention is low, and therefore, the dispenser-container can be economically manufactured.

In addition, when the shape maintaining member is of a box shape, it is easy to stack the dispenser-containers. The contents contained in the dispenser-container are not deformed nor crumbled. The stocking efficiency of the dispenser-container of the present invention is high. Accordingly, it is easy to handle, and its transportation, storage and display are readily performed.

When a consumer wants to use a part of contents and to store the remaining contents, it is easy for him to arrange the contents properly with the dispenser-container. For example, nails can be stored with safety.

Besides, in this case, the shape of the container 1 is not deformed nor distorted even when the wet tissues remaining in the container body becomes small as the wet tissues are dispensed. Accordingly, the wet tissues contained in the container 1 remain flat as they were flat upon beginning of use, and they can be smoothly dispensed.

Further, when cookies or biscuits are packaged in a dispenser-container of the present invention, the container can be sealed again once the container is unpacked. Accordingly, dry cookies or biscuits do not become damp, and wet cakes do not become dry. In addition, since dust does not enter into the container, the contents can be stored sanitarily.

What is claimed is:

1. A resealable dispenser-container comprising:

a deformable container, which is made of a flexible sheet; and a shape maintaining member, which is made of a material harder than said container;

said container containing contents;

said container having an opening for dispensing said contents therethrough and a flap secured to said container at all times, said flap made of a flexible sheet material which covers said opening and which is repeatedly opened and closed;

said shape maintaining member having an opening means for defining larger than said opening formed in said container;

said opening formed on said container being located within said opening formed in said shape maintaining member; and said sheet of said container being fixed to said shape maintaining member at a position near said opening formed in said container.

2. A resealable dispenser-container according to claim 1, wherein said container is made of gas impervious sheet and said flap is also made of gas impervious sheet.

3. A resealable dispenser-container according to claim 1, wherein said shape maintaining member is formed in a box structure.

4. A resealable dispenser-container according to claim 1, wherein said shape maintaining member formed in a box structure has a plurality of containers contained therein.

5. A resealable dispenser-container according to claim 1, wherein said shape maintaining member is formed in a frame structure.

6. A resealable dispenser-container according to claim 1, wherein said shape maintaining member is formed in a plate.

7. A resealable dispenser-container according to claim 6, wherein said shape maintaining member formed in a plate is fixed to an outer surface of said container.

8. A resealable dispenser-container according to claim 6, wherein said shape maintaining member formed in a plate is fixed to an inner surface of said container.

9. A resealable dispenser-container comprising:

a deformable container, which is made of a flexible sheet; and a shape maintaining member, which is made of a material harder than said container;

said container containing contents;

said container having a weakened line for forming an opening to dispense said contents therethrough and a flap secured to said container at all times, said flap being made of a flexible sheet material which covers said weakened line and which is repeatedly opened and closed;

said shape maintaining member having a weakened line for forming an opening, which weakened line is larger than said weekend line formed in said container;

said weakened line formed on said container being located within a region surrounded by said weakened line formed in said shape maintaining member; and said sheet of said container being fixed to said shape maintaining member at a position near said weakened line formed in said container.

10. A resealable dispenser-container according to claim 9, wherein said container is made of gas impervious sheet and said flap is also made of gas impervious sheet.

11. A resealable dispenser-container according to claim 9, wherein said shape maintaining member is formed in a box structure.

12. A resealable dispenser-container according to claim 9, wherein said shape maintaining member formed in a box structure has a plurality of containers contained therein.

13. A resealable dispenser-container according to claim 9, wherein said shape maintaining member is formed in a frame structure.

14. A resealable dispenser-container according to claim 9, wherein said shape maintaining member is formed in a plate.

15. A resealable dispenser-container according to claim 14, wherein said shape maintaining member formed in a plate is fixed to an outer surface of said container.

16. A resealable dispenser-container according to claim 14, wherein said shape maintaining member formed in a plate is fixed to an inner surface of said container.

17. A resealable dispenser-container comprising:

a deformable container, which is made of a flexible sheet; and a shape maintaining member, which is made of a material harder than said container;

said container containing contents;

said container having a weakened line for forming an opening to dispense said contents therethrough and a flap secured to said container at all times, said flap being made of a flexible sheet material which covers said weakened line and which is repeatedly opened and closed;

said shape maintaining member having means for defining an opening larger than said weakened line formed in said container;

said weakened line formed on said container being located within said opening formed in said shape maintaining member; and said sheet of said container being fixed to said shape maintaining member at a position near said weakened line formed in said container.

18. A resealable dispenser-container according to claim 17, wherein said container is made of gas impervious sheet and said flap is also made of gas impervious sheet.

19. A resealable dispenser-container according to claim 17, wherein said shape maintaining member is formed in a box structure.

20. A resealable dispenser-container according to claim 17, wherein said shape maintaining member formed in a box structure has a plurality of containers contained therein.

21. A resealable dispenser-container according to claim 17, wherein said shape maintaining member is formed in a frame structure.

22. A resealable dispenser-container according to claim 17, wherein said shape maintaining member is formed in a plate.

23. A resealable dispenser-container according to claim 22, wherein said shape maintaining member formed in a plate is fixed to an outer surface of said container.

24. A resealable dispenser-container according to claim 22, wherein said shape maintaining member formed in a plate is fixed to an inner surface of said container.

25. A resealable dispenser-container comprising:

a deformable container, which is made of a flexible sheet; and a shape maintaining member, which is made of a material harder than said container;

said container containing contents;

said container having an opening for dispensing said contents therethrough and a flap secured to said container at all times, said flap being made of a flexible sheet material which covers said opening and which is repeatedly opened and closed;

said shape maintaining member having a weakened line for for forming an opening, which weakened line is larger than said opening formed in said container;

said opening formed on said container being located within a region surrounded by said weakened line formed in said shape maintaining member; and said sheet of said container being fixed to said shape maintaining member at a position near said opening formed in said container.

26. A resealable dispenser-container according to claim 25, wherein said container is made of gas impervious sheet and said flap is also made of gas impervious sheet.

27. A resealable dispenser-container according to claim 25, wherein said shape maintaining member is formed in a box structure.

28. A resealable dispenser-container according to claim 25, wherein said shape maintaining member formed in a box structure has a plurality of containers contained therein.

29. A resealable dispenser-container according to claim 25, wherein said shape maintaining member is formed in a frame structure.

30. A resealable dispenser-container according to claim 25, wherein said shape maintaining member is formed in a plate.

31. A resealable dispenser-container according to claim 30, wherein said shape maintaining member formed in a plate is fixed to an outer surface of said container.

32. A resealable dispenser-container according to claim 30, wherein said shape maintaining member formed in a plate is fixed to an inner surface of said container.

* * * * *